US005266042A

United States Patent [19]

Hampel

[11] Patent Number: 5,266,042

[45] Date of Patent: Nov. 30, 1993

[54] ELECTRICAL JACK AND PATCH PLUG ASSEMBLY

[75] Inventor: Herbert J. Hampel, Feasterville, Pa.

[73] Assignee: Eastern Research, Inc., Hatboro, Pa.

[21] Appl. No.: 937,342

[22] Filed: Aug. 31, 1992

[51] Int. Cl.[5] ..... H01R 29/00

[52] U.S. Cl. ..... 439/188; 439/669

[58] Field of Search ..... 439/668, 669, 188, 733, 439/507, 55, 63; 200/51.1, 51.07, 51.09

[56] References Cited

U.S. PATENT DOCUMENTS

| | | | |
|---|---|---|---|
| 1,526,102 | 2/1925 | Taft | 439/188 |
| 4,237,352 | 12/1980 | Seiden | 200/51.03 |
| 4,256,936 | 3/1981 | Lancaster | 200/51.07 |
| 4,358,135 | 11/1982 | Tsuge et al. | 439/188 |
| 4,423,466 | 12/1983 | Beun | 439/668 |
| 4,588,251 | 5/1986 | Newton | 439/668 |
| 4,705,921 | 11/1987 | Rabey et al. | 200/51.09 |
| 5,145,416 | 9/1992 | Cruise et al. | 439/188 |

OTHER PUBLICATIONS

Switchcraft catalog excerpt, "TT-JAX" telephone twin jacks, pp. 1-14 through 1-16.

*Primary Examiner*—Larry I. Schwartz
*Assistant Examiner*—Hien D. Vu
*Attorney, Agent, or Firm*—William H. Eilberg

[57] ABSTRACT

A jack facilitates the patching of one or more external circuits into an electrical line. In the normal condition, the electrical line maintains continuity through the use of a pair of metal springs which make connections between pairs of contacts. Each spring has a rounded projection and a rounded depression. The depressions serve as pivot points for the springs. When one applies pressure to the rounded projection, such as by inserting a prong of a male plug over the spring, the spring pivots and breaks the electrical connection with one of the contacts. Moreover, the positions of the rounded projections of the two springs correspond to the positions of tip and ring portions of the prong, thereby connecting the springs respectively to the tip and ring portions. Thus, insertion of the male plug breaks the continuity of the line and connects the line to an external circuit, while removal of the plug restores the continuity of the line.

15 Claims, 4 Drawing Sheets

ELECTRICAL JACK AND PATCH PLUG ASSEMBLY

BACKGROUND OF THE INVENTION

This invention relates to the field of electrical jacks, especially those jacks commonly used with telephone circuits. However, one can use the invention in other fields. In general, the present invention provides a jack which enables the user to patch an external circuit into a normally unbroken electrical line.

The prior art shows various examples of electrical jacks, and especially telephone jacks. One uses such jacks to provide access to a telephone or computer circuit by insertion of a male plug into the jack. U.S. Pat. No. 4,256,936 shows one example. In the latter patent, insertion of a plug breaks certain normally closed circuits, and directs the telephone or other signals into a circuit connected to the plug. The latter patent also shows that one can attach the jack to a printed circuit board.

The present invention provides an alternative arrangement for connecting a telephone plug to a circuit. In particular, the present invention provides structure wherein insertion of the plug into the jack mechanically moves a spring away from an electrical contact, thereby breaking a normally closed connection. The jack requires no soldered joints to make the required connection. One can mount the jack of the present invention on a printed circuit board. One can also provide pairs of such jacks, arranged on the same side or on different sides of a circuit board, and one can make or break multiple connections by insertion of a multi-pronged plug.

SUMMARY OF THE INVENTION

The jack of the present invention includes a pair of springs, each spring comprising an elongated metal strip. One arranges the strips spaced apart from each other, and in a mutually parallel orientation. Also, one displaces the strips longitudinally relative to each other. Both springs sit within a housing which also accommodates two pairs of electrical contacts. Each spring normally completes an electrical connection between the two contacts of each pair. Due to an electrical connection between one contact of one pair and one contact of the other pair, the springs comprise two normally closed switches connected in series.

Each spring further includes a rounded projection and a rounded depression. A bar, attached to the housing, extends across the depression of each of the springs, and holds its spring against the housing. When one exerts pressure on the projection, in a direction towards the housing, the pressure causes the spring to pivot about the bar, and the end of the spring opposite the projection moves away from the contact. In this way, pressure on the projection causes the spring to break its normally closed electrical connection.

Insertion of a male telephone plug provides the pressure on the spring necessary to break the electrical connection. The plug includes a prong having a tip portion and a ring portion, separated from each other by a suitable insulator. The projections have a shape which causes them to make electrical connections with the correct portion of the prong. The projection on one spring touches the tip portion of the prong, and the projection on the other spring touches the ring portion. Thus, insertion of the plug connects the circuits represented by the tip and ring portions to the target circuit, while breaking the circuit previously made by the undisturbed springs.

For use as a telephone patching device, one needs two pairs of springs as described above. A different male plug actuates each pair of springs. One can mount the springs, in their housing, on a printed circuit board. Both pairs of springs may sit on the same side of the board, or one can position them in separate housings on opposite sides of the board. In either case, one can insert a two-pronged plug into the jack in one movement.

The present invention therefore has the primary object of providing a jack in which insertion of a plug breaks a normally closed connection and establishes an electrical connection between an external circuit and the circuit terminating at the jack.

The present invention has the further object of providing a jack as described above, wherein one can mount the jack to a printed circuit board.

The invention has the further object of providing a double jack which fits on either side of a printed circuit board, and which accommodates a two-pronged male plug.

The invention has the further object of reducing the cost and increasing the reliability of jacks as described above.

The invention has the further object of providing a telephone jack for use in a patching device.

The person skilled in the art will recognize other objects and advantages of the invention, from a reading of the following brief description of the drawings, the detailed description of the invention, and the appended claims.

DETAILED DESCRIPTION OF THE INVENTION

Figure 1:
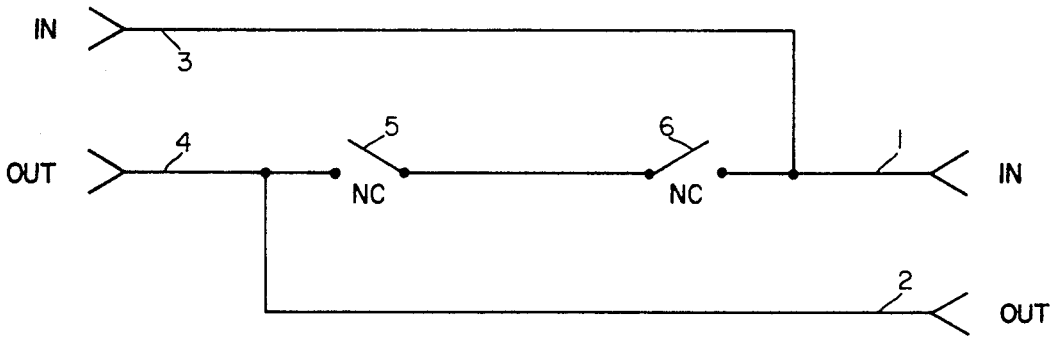
FIG. 1 shows a circuit diagram representing the electrical equivalent of a simplified embodiment of the device of the present invention.

FIG. 1 shows a simplified circuit diagram illustrating the type of problem solved by the present invention. When used as part of a telephone patching arrangement, the actual configuration differs from FIG. 1 because one needs to accommodate more conductors. This specification will discuss those differences later. However, FIG. 1 suffices to illustrate the invention in its most basic form.

The present invention solves the problem of breaking into an electrical line to connect an external circuit to that line, using solderless joints for making and breaking connections. In FIG. 1, suppose that terminals 1 and 2 represent two points along a wire; these points would normally have an electrical connection between them. Terminals 3 and 4 represent the terminals of an external circuit. Normally-closed switches 5 and 6 maintain the electrical connection between terminals 1 and 2. When one connects a plug, from an external circuit, to terminals 3 and 4, switches 5 and 6 both open, by mechanical means not illustrated in FIG. 1, breaking the connection between terminals 1 and 2, and connecting terminals 3 and 4 to terminals I and 2, respectively. The present invention resides primarily in the physical structure which accomplishes the above-described switching.

Figure 2:
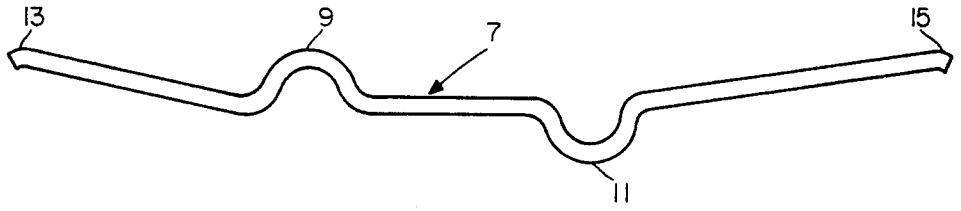
FIG. 2 provides a side elevational view of one of the springs used in the present invention to make and break electrical contact.

The present invention uses the spring shown in FIG. 2 as the basic switching element. This spring forms the major component of the switches represented symbolically in FIG. 1 as elements 5 and 6. As shown in the elevational view of FIG. 2, each spring 7 comprises an elongated strip of metal which has rounded projection 9 and rounded depression 11. Ends 13 and 15 of spring 7 make connections with electrical contacts, not shown in FIG. 2.

Figure 3:
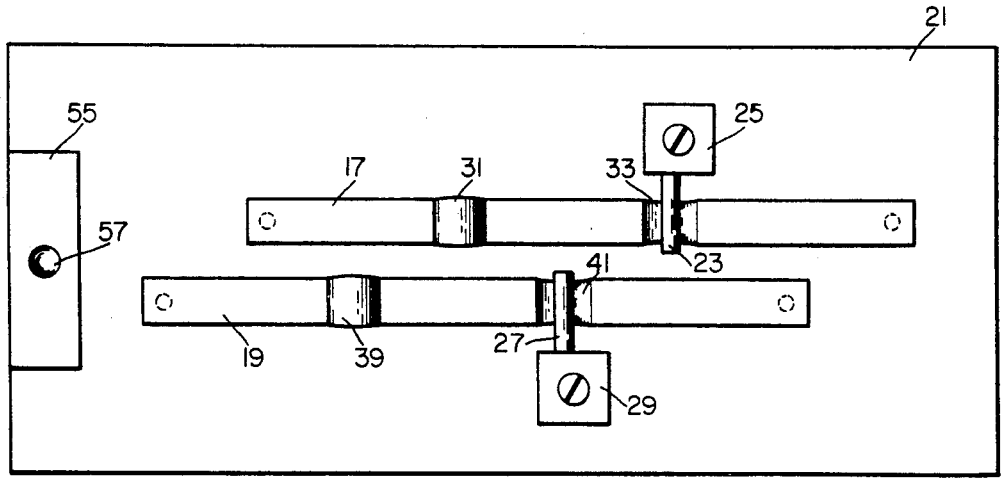
FIG. 3 provides a top view of the jack of the present invention, showing the springs which make and break electrical contact.
Figure 4:
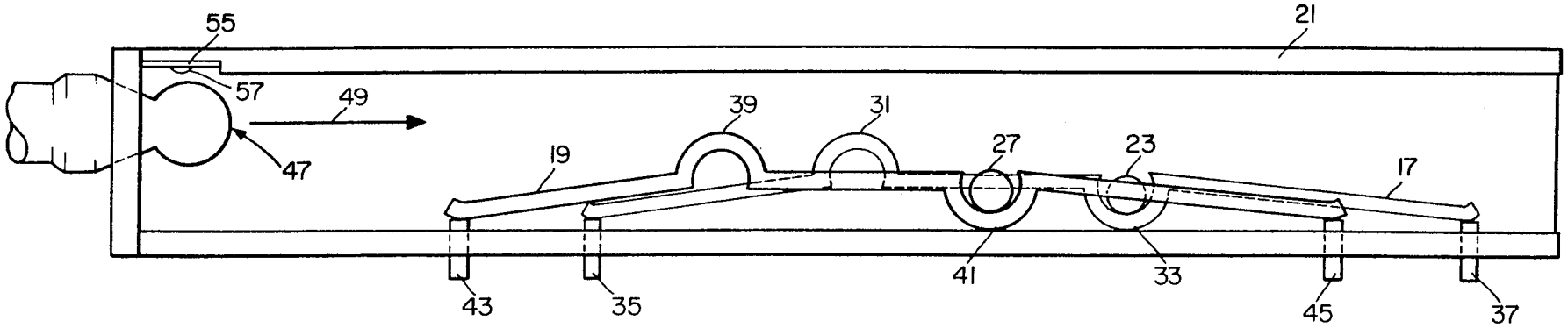
FIG. 4 shows the jack of the present invention in an elevational view taken from the same direction as in FIG. 2, with a male plug beginning to slide into the jack.
Figure 5:
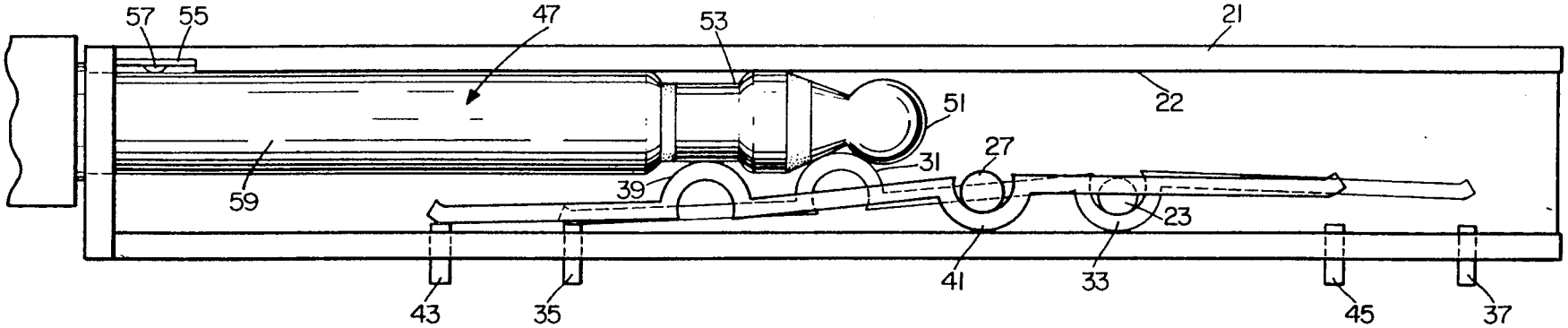
FIG. 5 shows a view similar to that of FIG. 4, but with the male plug fully inserted into the jack.

FIGS. 3, 4, and 5 best illustrate the operation of the jack of the present invention. As shown in the top view of FIG. 3, a pair of springs 17 and 19 (similar to the spring shown in isolation in FIG. 2) sit within housing 21. As shown in FIG. 3, one arranges springs 17 and 19 spaced apart from each other, and in mutually parallel relation. Also, one displaces the springs longitudinally from one another, as shown. Bar 23 rests within depression 33 of spring 17. Mounting device 25 holds the bar in place, thus keeping spring 17 in position. FIG. 3 shows that one can affix mounting device 25 to housing 21 with a screw; one can also use other means for affixing the mounting device. A similar bar 27 and mounting device 29 holds spring 19 in place within depression 41 of spring 19.

FIG. 4 shows, in a side elevational view, more structure of the jack of the present invention. In particular, FIG. 4 shows spring 17 with its rounded projection 31, its rounded depression 33, and bar 23 holding the spring in place. Spring 17 electrically engages contacts 35 and 37. The end of the spring remains free to move away from contact 37; in the normal position, it simply abuts the contact. As described below, one intends the spring to move away from contact 37 to break an electrical connection. FIG. 4 also shows that spring 17 has only electrical, but not mechanical, connection with contact 35. The elastic force of the spring insures that the spring will always make a connection with contact 35. Alternatively, one could anchor the spring to contact 35. However, the end of the spring must always remain free to move away from contact 37.

Spring 19 has a structure similar to that of spring 17. FIG. 4 shows rounded projection 39, rounded depression 41, and bar 27. Spring 19 engages contacts 43 and 45. Similarly to spring 17, spring 19 abuts contact 45, and can move away from that contact, as described below. Spring 19 also makes an electrical connection with contact 43.

FIGS. 4 and 5 show what happens when one inserts a male plug into the jack. FIG. 4 shows prong 47 of a male plug as it begins to move into the jack, in the direction indicated by arrow 49. FIG. 5 shows the jack with the prong of the male plug completely inserted. The prong includes a tip portion 51 and a ring portion 53. Tip portion 51 and ring portion 53 define contacts electrically isolated from each other. The male plug has an entirely conventional structure, and fits within a cavity defined by the housing. The cavity has its center between the springs, so that the prong can engage both springs simultaneously, as described below.

As the prong of the male plug enters the jack, it encounters moderate obstructions in the form of rounded projections 31 and 39 of springs 17 and 19, respectively. Since the prong enters the cavity defined by housing 21, the prong must remain within that cavity. Inner wall 22 of housing 21 prevents the prong from moving away from the springs. Thus, as the prong moves over the springs, its tip portion 51 must press down on rounded projection 31, and its ring portion 53 must press down on rounded projection 39. In pressing down on these projections, the prong causes the springs to pivot about points directly below the bars 23 and 27. The ends of the springs therefore move away from contacts 37 and 45 (they move upward as viewed in FIGS. 4 and 5). Movement of the spring does not affect the electrical connections with contacts 35 and 43. Rounded projection 39 of spring 19 makes an electrical connection with ring portion 53, and rounded projection 31 makes an electrical connection with tip portion 51.

The above description shows why one displaces the springs longitudinally. By so doing, one insures that one of the rounded projections contacts the tip portion of the prong, and that the other projection will contact the ring portion of the prong.

When one removes the male plug with its prong, the elasticity of the metal springs cause their ends to return to contacts 37 and 45, restoring the electrical connections previously made.

In order to make the device shown in FIGS. 3–5 perform the function of the circuit of FIG. 1, one needs an additional connection not shown in these figures: one must connect contacts 37 and 45 together electrically. One can make such connection internally, within the housing. Alternatively, the entire jack can sit on a printed circuit board, and one can provide the necessary connection with a conductive path on the board. Connecting contacts 37 and 45 yields two normally closed switches connected in series, as shown in FIG. 1.

One can summarize the operation of the jack, with reference to the circuit diagram of FIG. 1, as follows. We identify contact 35 with terminal 1 of FIG. 1, and we identify contact 43 as terminal 2. Then we identify tip portion 51 of prong 47 with terminal 3 and ring portion 53 with terminal 4. Now, in the absence of the prong, current entering at contact 35 (terminal 1) flows through spring 17, to contact 37, to contact 45 (because of the connection between contacts 37 and 45), back through spring 19, and to contact 43 (terminal 2), as shown in FIG. 1. Thus, terminals I and 2 have an electrical connection between them.

When one inserts the prong, the springs move away from contacts 37 and 45, breaking the connection between terminals 1 and 2. Now, current from tip portion 51 (terminal 3) flows through spring 17 to contact 35 (terminal 1) and current from contact 43 (terminal 2) flows through spring 19 to ring portion 53 (terminal 4).

The above discussion proves the equivalence between the physical embodiment of FIGS. 3–5 and the circuit diagram of FIG. 1.

The jack of the present invention may also include grounding member 55 having protrusion 57. The protrusion makes contact with the ground portion 59 of prong 47, and enables one to connect this ground portion electrically to ground.

Figure 6:
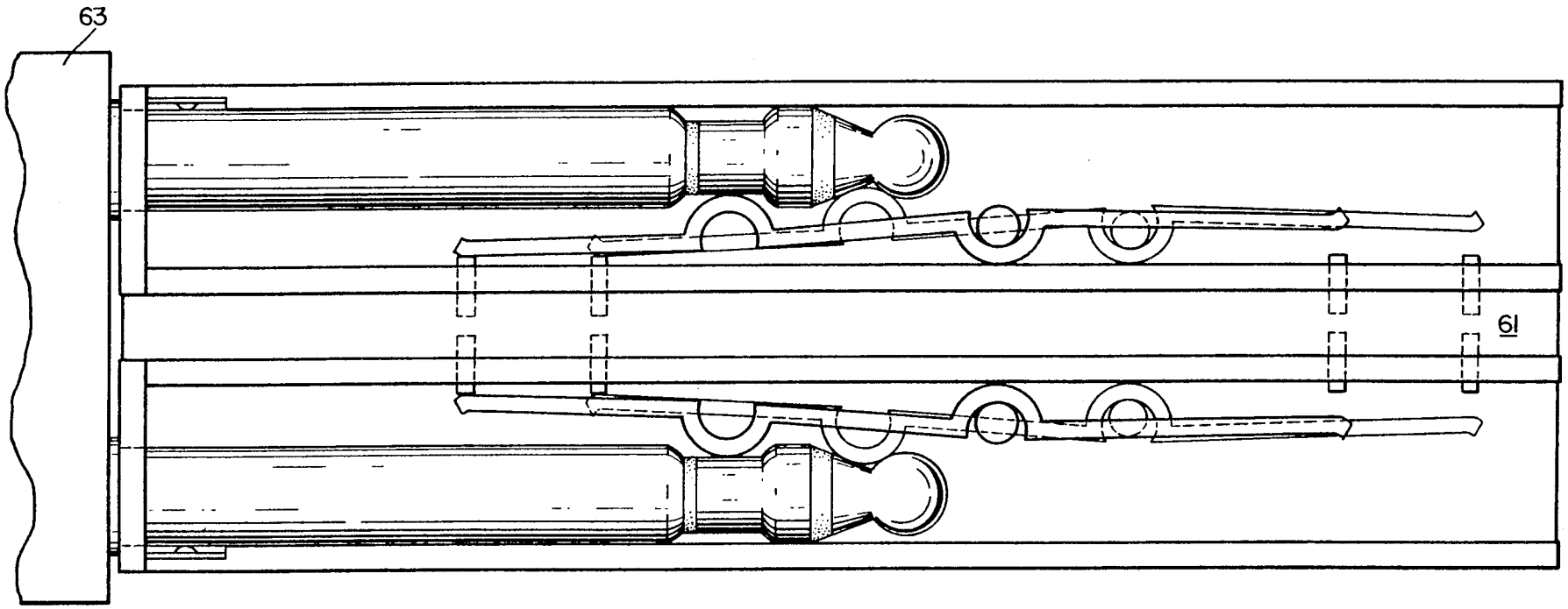
FIG. 6 provides an elevational view of an embodiment of the invention wherein two male plugs engage two jacks disposed on either side of a printed circuit board.

FIG. 6 illustrates an embodiment which accommodates two prongs and two pairs of springs. This embodiment essentially comprises two copies of the apparatus shown in FIG. 5, the two copies disposed on opposite sides of a printed circuit board 61. The male plug shown in FIG. 6 includes two prongs mounted in a single prong housing 63. The prongs need not form part of the same plug; one could insert separate and independent plugs each having one prong.

One can also arrange two pairs of springs on the same side of a printed circuit board, in which case one can insert a two-pronged plug with both prongs on the same side of the board. In all cases, the springs operate in the same manner described with respect to FIGS. 3–5.

Figure 7:
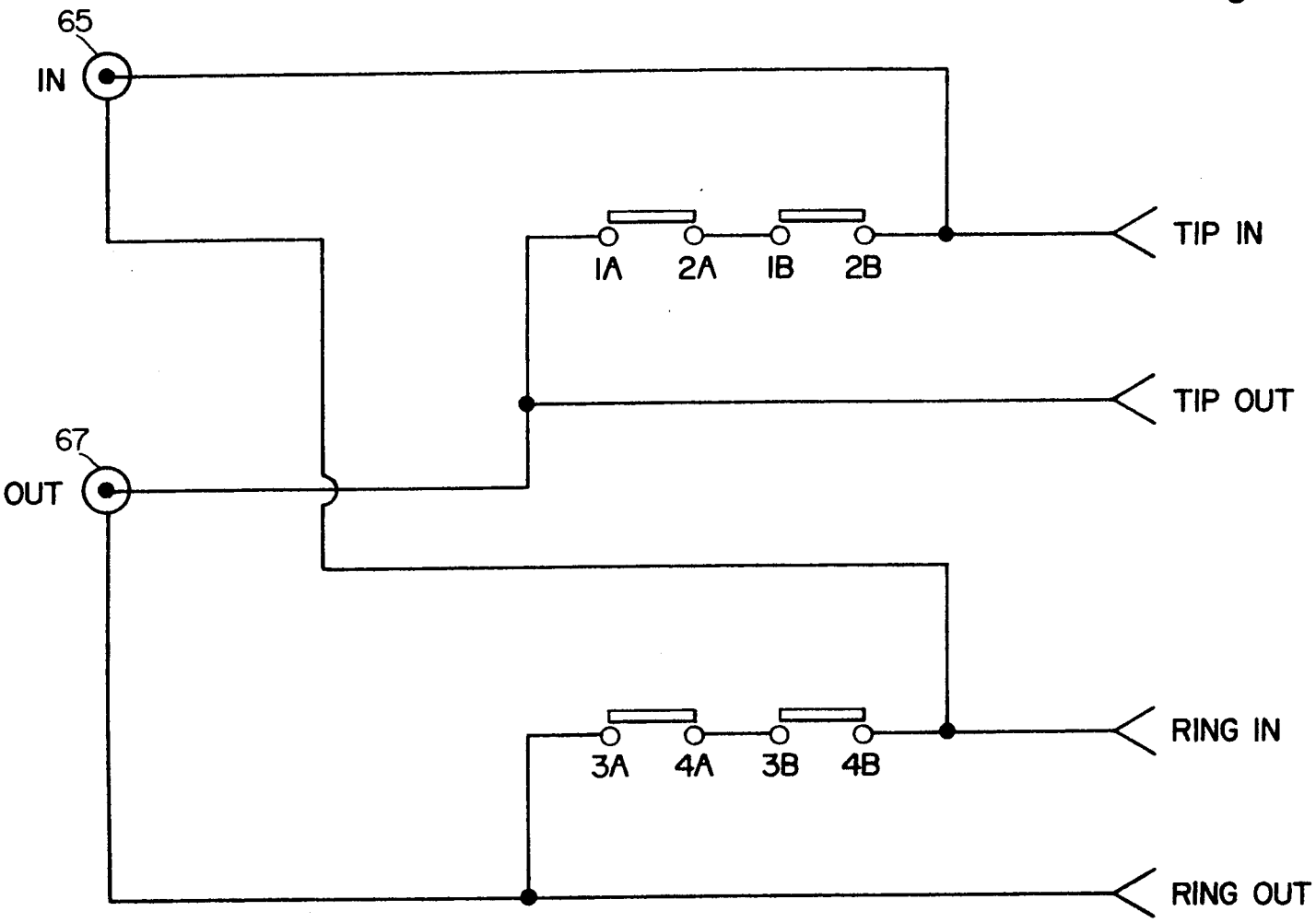
FIG. 7 provides a circuit diagram showing the use of the jack of the present invention as part of a telephone patching device.

FIG. 7 provides a circuit diagram showing how one could use the embodiment of FIG. 6 (or its equivalent) in a telephone patching device. Assume that the telephone wire includes two conductors. We designate one conductor as "tip" and the other as "ring". The "tip" conductor includes an "IN" and "OUT" lead, as does the "ring" conductor. The switches bridging the contacts labeled 1A and 2A, 1B and 2B, 3A and 4A, and 3B and 4B comprise springs of the type described previously. Thus, FIG. 7 shows four normally closed spring switches. In the absence of any male plug in either of plug receptacles 65 or 67, the "tip IN" conductor remains connected to the "tip OUT" conductor, and the "ring IN" conductor remains connected to "ring OUT".

When one inserts a male plug into receptacle 65, with no plug present in receptacle 67, one breaks the connection between contacts 1B and 2B, and between 3B and 4B, in the same manner described with respect to FIGS. 3–5. At this point, "tip IN" connects to the tip contact of receptacle 65, and "ring IN" connects to the ring contact of receptacle 65.

When one inserts a male plug into receptacle 67, with no plug present in receptacle 65, one breaks the connection between contacts 1A and 2A, and between 3A and 4A, in the same manner described above. Now, "tip OUT" connects to the tip contact of receptacle 67, and "ring OUT" connects to the ring contact of receptacle 67.

If one inserts male plugs into both receptacles 65 and 67, all of the normally closed spring switches become opened, and both receptacles become connected to the appropriate lines, as described above, independently of each other.

While the specification has described the invention with respect to certain preferred embodiments, one may vary the invention in many ways. For example, one can change the number of prongs on a plug, and the position of the prong cavities or receptacles. Also, instead of displacing the springs longitudinally, one can simply alter the longitudinal position of the projections, to insure that the correct projection contacts the correct portion of the prong. One can find applications for the jack of the present invention in fields other than in telephone circuits; the latter represents only one possibility. The person skilled in the art will recognize the possibility of further modifications, which one should consider within the spirit and scope of the following claims.

What is claimed is:

1. A jack for interrupting an electrical line and for connecting that line to an external circuit, the jack comprising:

a) a pair of springs, each spring comprising an elongated strip of metal, the springs being spaced apart from each other and being generally parallel to each other, one of the springs being displaced longitudinally relative to the other spring, both springs having first and second ends, b) both springs being mounted in a housing, the housing accommodating two pairs of electrical contacts, each pair of contacts being positioned within the housing such that one of the springs can complete an electrical connection between the contacts of a pair, c) each spring including a rounded projection and a rounded depression, wherein there is a bar means extending across each depression for holding the spring against the housing, wherein the second end of each spring can pivot upon application of pressure to the projection on said spring, and wherein pivoting of the spring breaks the contact between said spring and one of said contacts.

2. The jack of claim 1, further comprising a male plug, the male plug having a prong including a tip portion and a ring portion electrically isolated from each other, wherein the projection of one spring is positioned to contact the tip portion of the prong and the projection of the other spring is positioned to contact the ring portion of the prong, and wherein the housing defines means for enabling the prong to exert pressure on the projections so as to break the contact between each of the springs and one of their contacts.

3. The jack of claim 2, wherein there are at least two pairs of springs, each pair of springs accommodating one male plug.

4. The jack of claim 2, wherein there are two pairs of springs, disposed on either side of a printed circuit board, and wherein the male plug has two prongs, wherein one prong is inserted on one side of the circuit board and the other prong is inserted on the other side of the circuit board.

5. A jack for patching an external circuit into an electrical line, the jack comprising:

a) means defining first terminals extending from the electrical line, the first terminals being normally connected together electrically, such that the electrical line is normally unbroken, b) means defining second terminals connectable to the external circuit, the second terminals being connected respectively to the first terminals, and c) means for breaking the electrical connection between the first terminals, wherein the breaking means comprises an electrically conductive spring engaged with a pair of electrical contacts, the spring having two ends, wherein one end moves away from one of said contacts when pressure is applied to the spring.

6. The jack of claim 5, wherein the spring includes a rounded projection and means defining a pivot point for the spring, wherein pressure on the projection causes the spring to pivot so as to move away from said one of said contacts.

7. The jack of claim 6, wherein there are two springs, arranged side by side and substantially parallel to each other, wherein the rounded projection of one spring is displaced longitudinally with respect to the rounded projection of the other spring.

8. The jack of claim 7, in combination with a male plug, the plug having a prong, the prong including a tip portion and a ring portion, the tip and ring portions being electrically isolated from each other, wherein the spring sits within a housing defining a cavity for insertion of the plug, wherein movement of the plug into the cavity and over the springs exerts pressure on the rounded projections of both springs, and wherein the projections are positioned such that the projection of one spring makes contact with the tip portion of the prong, and the projection of the other spring makes contact with the ring portion of the prong.

9. The jack of claim 8, wherein there are at least two pairs of springs, each pair of springs accommodating one male plug.

10. The jack of claim 8, wherein there are two pairs of springs, disposed on either side of a printed circuit board, and wherein the male plug has two prongs, wherein one prong is inserted on one side of the circuit board and the other prong is inserted on the other side of the circuit board.

11. A jack comprising a pair of electrically conductive springs, the springs having first and second ends, the springs being positioned to complete an electrical connection between two contacts, each spring having a projection, wherein each spring is held to a housing at a pivot point located between said first and second ends, in a configuration such that pressure on the projection near the first end of the spring causes the second end of the spring to move away from one of the contacts, thereby breaking an electrical connection.

12. The jack of claim 11, wherein the projection is positioned for abutment with a portion of a conductive prong inserted into the jack, wherein abutment of the projection with the portion of the prong completes an electrical connection between the jack and an external circuit.

13. The jack of claim 12, wherein the prong has a tip portion and a ring portion, and wherein the projection of one spring is positioned to abut the tip portion and the projection of the other spring is positioned to abut the ring portion.

14. The jack of claim 13, wherein there are at least two pairs of springs, each pair of springs accommodating one male plug having two prongs.

15. The jack of claim 13, wherein there are two pairs of springs, disposed on either side of a printed circuit board, and wherein the male plug has two prongs, wherein one prong is inserted on one side of the circuit board and the other prong is inserted on the other side of the circuit board.

* * * * *